US009174473B2

(12) United States Patent
Yajima

(10) Patent No.: US 9,174,473 B2
(45) Date of Patent: Nov. 3, 2015

(54) LIQUID EJECTING APPARATUS

(71) Applicant: SEIKO EPSON CORPORATION, Tokyo (JP)

(72) Inventor: Yasushi Yajima, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/043,265

(22) Filed: Oct. 1, 2013

(65) Prior Publication Data

US 2014/0092191 A1 Apr. 3, 2014

(30) Foreign Application Priority Data

Oct. 3, 2012 (JP) ..... 2012-221032

(51) Int. Cl.
*B41J 2/01* (2006.01)
*B41J 29/17* (2006.01)

(52) U.S. Cl.
CPC ..... *B41J 29/17* (2013.01)

(58) Field of Classification Search
CPC ..... B41J 11/007; B41J 11/06; B41J 11/0085; B41J 13/103; B41J 11/0065
USPC ..... 347/104, 34
See application file for complete search history.

(56) References Cited

U.S. PATENT DOCUMENTS 4,494,166 A 1/1985 Billings et al.
5,155,525 A * 10/1992 Jones et al. ..... 355/132
5,735,009 A 4/1998 Saito et al.
6,183,153 B1 * 2/2001 Kamoda et al. ..... 400/613
6,219,505 B1 4/2001 Sato et al.
2007/0146456 A1 * 6/2007 Tanabe ..... 347/101
2007/0209539 A1 9/2007 Mori
2009/0185817 A1 * 7/2009 Mori ..... 399/99
2010/0165368 A1 * 7/2010 Matsuoka ..... 358/1.9
2011/0122189 A1 * 5/2011 Shigeno et al. ..... 347/16
2012/0242730 A1 * 9/2012 Leighton et al. ..... 347/14

FOREIGN PATENT DOCUMENTS

EP 0622242 11/1994
EP 1428667 6/2004
JP 03-061982 3/1991
JP H03-61982 3/1991
JP 07-309045 11/1995
JP 2000-206850 7/2000

OTHER PUBLICATIONS

European Search Report for European Patent Application No. 13187256.6 dated Feb. 11, 2014.

* cited by examiner

*Primary Examiner* — Manish S Shah
*Assistant Examiner* — Yaovi Ameh
(74) *Attorney, Agent, or Firm* — Workman Nydegger

(57) ABSTRACT

A liquid ejecting apparatus includes a liquid ejecting unit that ejects ink onto paper, a medium holding portion that holds the paper to be fed to the liquid ejecting unit, and a removal portion that removes adhering objects that have adhered to the paper, in a feed path of the paper that is positioned lower than the medium holding portion.

8 Claims, 6 Drawing Sheets

LIQUID EJECTING APPARATUS

BACKGROUND

1. Technical Field

The present invention relates to liquid ejecting apparatuses that eject a liquid onto a medium such as paper.

2. Related Art

An ink jet printer that prints by ejecting ink onto paper (called simply a "printer" hereinafter) has been known as an example of a liquid ejecting apparatus that ejects a liquid onto a medium.

With this type of printer, when adhering objects such as paper particles adhere to the paper, nozzles that eject the liquid can be clogged by the adhering objects, leading to a drop in the print quality. Accordingly, a brush-shaped removal member has been provided in a transport path of the paper in order to remove such adhering objects from the paper (for example, see JP-A-3-61982).

In addition, some printers include a paper feed path that extends upward from a holding portion that holds paper fed toward a liquid ejecting head that ejects ink (for example, see JP-A-7-309045).

Incidentally, adhering objects removed from the paper accumulate on the removal member, and thus the adhering objects that have accumulated on the removal member may fall downward, such as when a following end of the paper passes the removal member. In the case where the removal member is disposed in the feed path extending upward from the holding portion, there is a risk that adhering objects falling from the removal member will adhere to the paper in the feed path, the holding portion, and the like that are positioned therebelow.

Note that this problem is not limited to printers that print by ejecting ink onto paper, and is generally present in all liquid ejecting apparatuses that include removal members for removing adhering objects that adhere to a medium.

SUMMARY

It is an advantage of some aspects of the invention to provide a liquid ejecting apparatus capable of suppressing adhering objects that have been removed by a removal member from adhering to a medium that is fed to a liquid ejecting unit.

A summary of aspects of the invention for achieving the aforementioned advantage, and of effects of the invention, will be described below.

A liquid ejecting apparatus according to an aspect of the invention includes: a liquid ejecting unit that ejects a liquid onto a medium; a medium holding unit that holds the medium to be fed to the liquid ejecting unit; and a removal unit that removes adhering objects that have adhered to the medium, in a feed path of the medium that is positioned lower than the medium holding unit.

According to this configuration, the removal unit removes the adhering objects that have adhered to the medium in the feed path of the medium that is positioned lower than the medium holding unit, and thus the adhering objects removed by the removal unit are held in a location that is lower than the medium holding unit. Through this, the adhering objects that have fallen from the removal unit can be suppressed from adhering to the medium in the feed path, medium holding unit, and so on that are located above the removal unit. Accordingly, the adhering objects removed by the removal unit can be suppressed from adhering to the medium that is fed to the liquid ejecting unit.

According to another aspect of the invention, in the stated liquid ejecting apparatus, the medium holding unit is disposed lower than the liquid ejecting unit, and the feed path extends toward the liquid ejecting unit from below the medium holding unit.

According to this configuration, the medium holding unit is disposed lower than the liquid ejecting unit and the feed path extends toward the liquid ejecting unit from below the medium holding unit, and thus the adhering objects removed by the removal unit are held in a location that is lower than the liquid ejecting unit and the medium holding unit. Accordingly, the adhering objects that have fallen from the removal unit can be suppressed from adhering to the medium, the liquid ejecting unit, and so on.

According to another aspect of the invention, in the stated liquid ejecting apparatus, the medium holding unit includes a support portion that supports a roll member, upon which the medium having a long shape is wrapped in a cylindrical shape, in a rotatable state, and the removal unit is disposed below the support portion.

According to this configuration, the removal unit is disposed below the support portion that supports the roll member in a rotatable state, and thus the adhering objects removed by the removal unit are held below the roll member. Accordingly, adhering objects that have fallen from the removal unit can be suppressed from adhering to the roll member.

According to another aspect of the invention, the stated liquid ejecting apparatus further includes three or more transport roller pairs, arranged along a feed direction from a side on which the medium holding unit is located toward a side on which the liquid ejecting unit is located, for feeding the medium. Here, the medium is fed while tension being applied to the medium between a first transport roller pair positioned on an upstream side in the feed direction and a second transport roller pair positioned on a downstream side in the feed direction, and the medium is held in a sagging state between a third transport roller pair positioned downstream from the second transport roller pair in the feed direction and the second transport roller pair; and the removal unit is disposed between the first transport roller pair and the second transport roller pair in the feed direction.

According to this configuration, the removal unit is disposed between the first transport roller pair and the second transport roller pair that transport the medium while applying tension thereto, and thus the adhering objects can be efficiently removed by the removal unit sliding along the medium to which the tension is applied.

According to another aspect of the invention, in the stated liquid ejecting apparatus, the removal unit removes the adhering objects that have adhered to the medium by making contact with the medium that is transported in a state in which a first surface of the medium, onto which the liquid is ejected, faces downward.

According to this configuration, the medium makes contact with the removal unit while being transported with the first surface facing downward, and thus the adhering objects removed from the medium can be suppressed from adhering to the first surface onto which the liquid is ejected.

According to another aspect of the invention, the liquid ejecting apparatus further includes a guide member for guiding the first surface side of the medium to be fed; here, a through-hole is provided in a position of the guide member that is below the removal unit, and a receptacle unit for collecting the adhering objects removed from the medium is disposed below the through-hole.

According to this configuration, in the case where adhering objects that have accumulated on the removal unit have fallen, the adhering objects can be cleared outside from the transport path through the through-hole. In addition, by collecting the adhering objects in the receptacle unit provided below the through-hole, the adhering objects can be held outside the transport path. Accordingly, the adhering objects can be expelled outside the transport path of the medium, and thus the adhering objects can be suppressed from adhering to the medium and the like.

According to another aspect of the invention, the liquid ejecting apparatus further includes: a holding frame that holds the medium holding unit, the removal unit, the guide member, and the receptacle unit; and a case body unit including a first housing section capable of housing the holding frame, and a second housing section that is disposed above the first housing section and that houses the liquid ejecting unit. Here, the receptacle unit is provided in a base area of the holding frame.

According to this configuration, the second housing section that houses the liquid ejecting unit is disposed above the first housing section, which is capable of housing the holding frame that holds the removal unit; thus adhering objects that have been removed by the removal unit can be suppressed from entering into the second housing section and adhering to the liquid ejecting unit. In addition, the receptacle unit is provided in a base area of the holding frame, and thus adhering objects that have been cleared outside from the transport path can be suppressed from scattering within the case body unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings.

Figure 1:
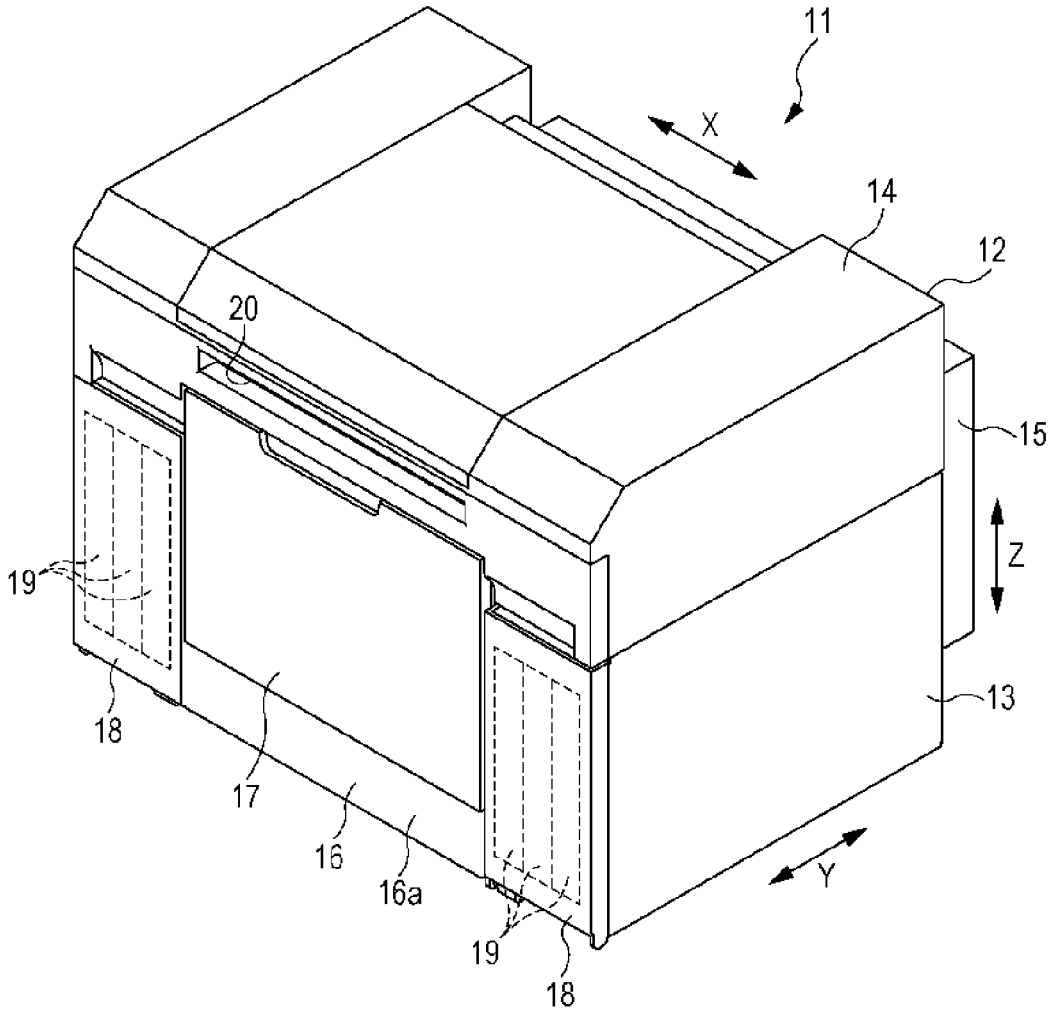
FIG. 1 is a perspective view illustrating a liquid ejecting apparatus according to an embodiment.

As shown in FIG. 1, a liquid ejecting apparatus 11 according to this embodiment includes an approximately rectangular-shaped case body unit 12. The case body unit 12 includes a first housing section 13, a second housing section 14 disposed above the first housing section 13, and a third housing section 15 disposed to the rear of the first housing section 13. Note that in this embodiment, a direction in which the second housing section 14 and the third housing section 15 are arranged, which intersects (orthogonally, in this embodiment) with a vertical direction Z that follows a gravitational direction, corresponds to a depth direction Y. Meanwhile, a lengthwise direction of the first housing section 13 and the second housing section 14, which intersects (orthogonally, in this embodiment) with the vertical direction Z and the depth direction Y, corresponds to a width direction X.

A holding frame 16 is housed in the first housing section 13 so as to be capable of being pulled out therefrom. Furthermore, a front end surface 16*a* of the holding frame 16, a front surface cover 17 attached in a removable state above the front end surface 16*a*, and an opening/closing cover 18 attached in a pivotable state to both sides of the holding frame 16 in the width direction X, are exposed on a front surface side of the first housing section 13.

The opening/closing cover 18 can be switched between a closed position, as shown in FIG. 1, and an open position in which an upper end area of the opening/closing cover 18 is lowered forward and the interior of the apparatus is exposed, by pivoting the upper end area of the opening/closing cover 18 central to a pivot shaft (not shown) provided in a lower end area thereof. When the opening/closing cover 18 is placed in the open position, a cartridge holder (not shown), in which ink cartridges 19 that hold ink serving as an example of a liquid are mounted in a removable state, is exposed. Furthermore, a discharge port 20 is formed in a front surface side of the second housing section 14.

Figure 2:
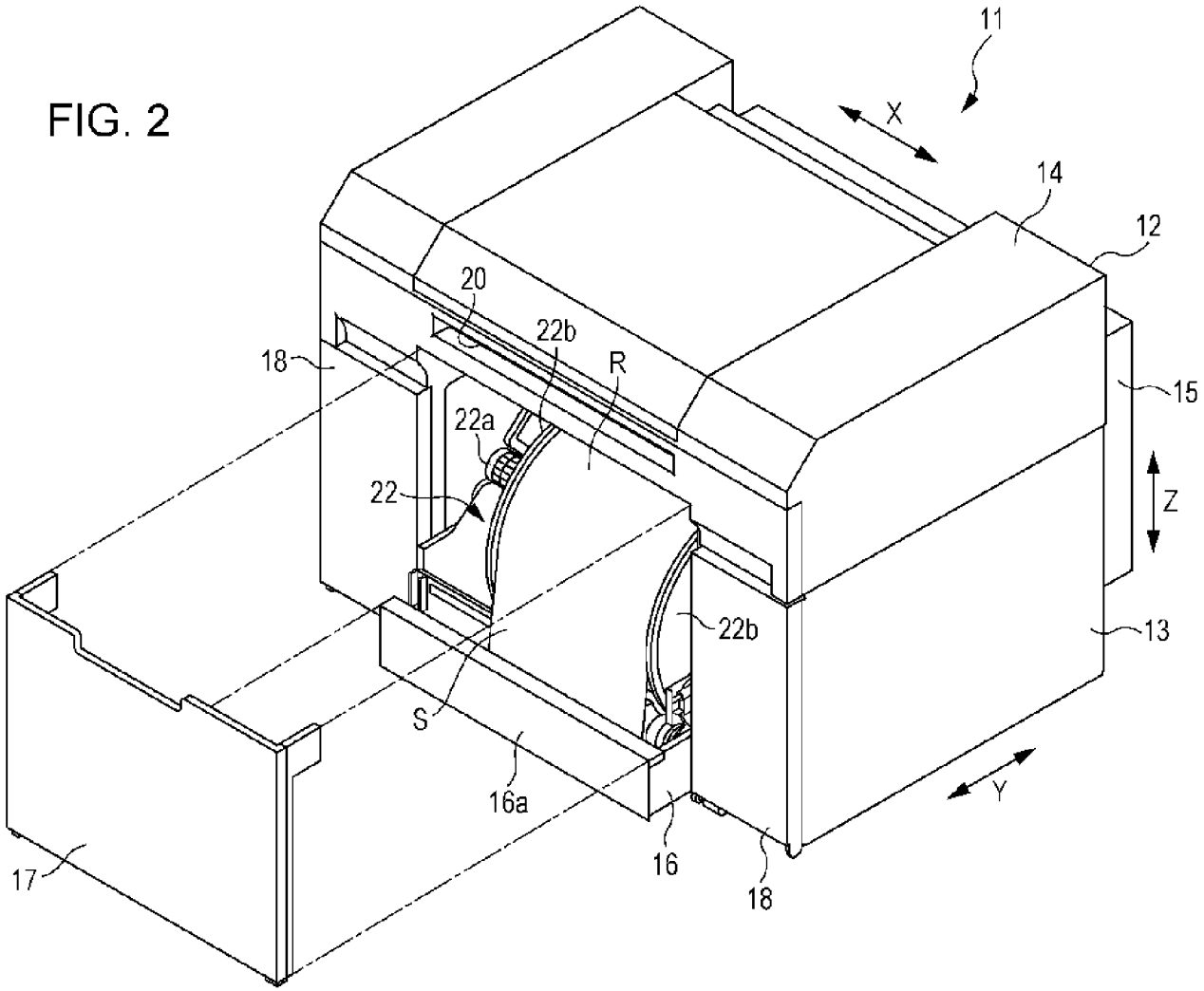
FIG. 2 is a perspective view illustrating a liquid ejecting apparatus from which a holding frame has been pulled out.

As shown in FIG. 2, a medium holding portion 22 that holds a roll member R around which a long paper S serving as an example of a medium is wrapped in a cylindrical shape is provided in the holding frame 16. Note that a plurality of roll members R having different sizes can be loaded on the medium holding portion 22, and can be replaced.

The medium holding portion 22 includes a support shaft 22*a* serving as an example of a support portion that supports the roll member R in a rotatable state, and a pair of flanges 22*b* that rotate integrally with the support shaft 22*a*. Of the flanges 22*b* that make up the pair, the flange 22*b* on a first end in the width direction X (the left side in FIG. 2) is capable of moving in the width direction X along the support shaft 22*a*.

When the roll member R is set on the medium holding portion 22, the front surface cover 17 is first removed from the case body unit 12, and the holding frame 16 is pulled forward from the case body unit 12, as shown in FIG. 2. Then, the roll member R is passed onto the support shaft 22*a*, and the flange 22*b* on the first end side is moved toward a second end (to the right, in FIG. 1) so that the flanges 22*b* pinch the roll member R on both ends thereof.

Note that in this embodiment, transporting the paper S from the medium holding portion 22 toward the second housing section 14 is referred to as "feeding", a transport path of the paper S in the first housing section 13 is referred to as a "feed path", and a direction in which the paper S is transported in the first housing section 13 is referred to as a "feed direction".

Figure 3:
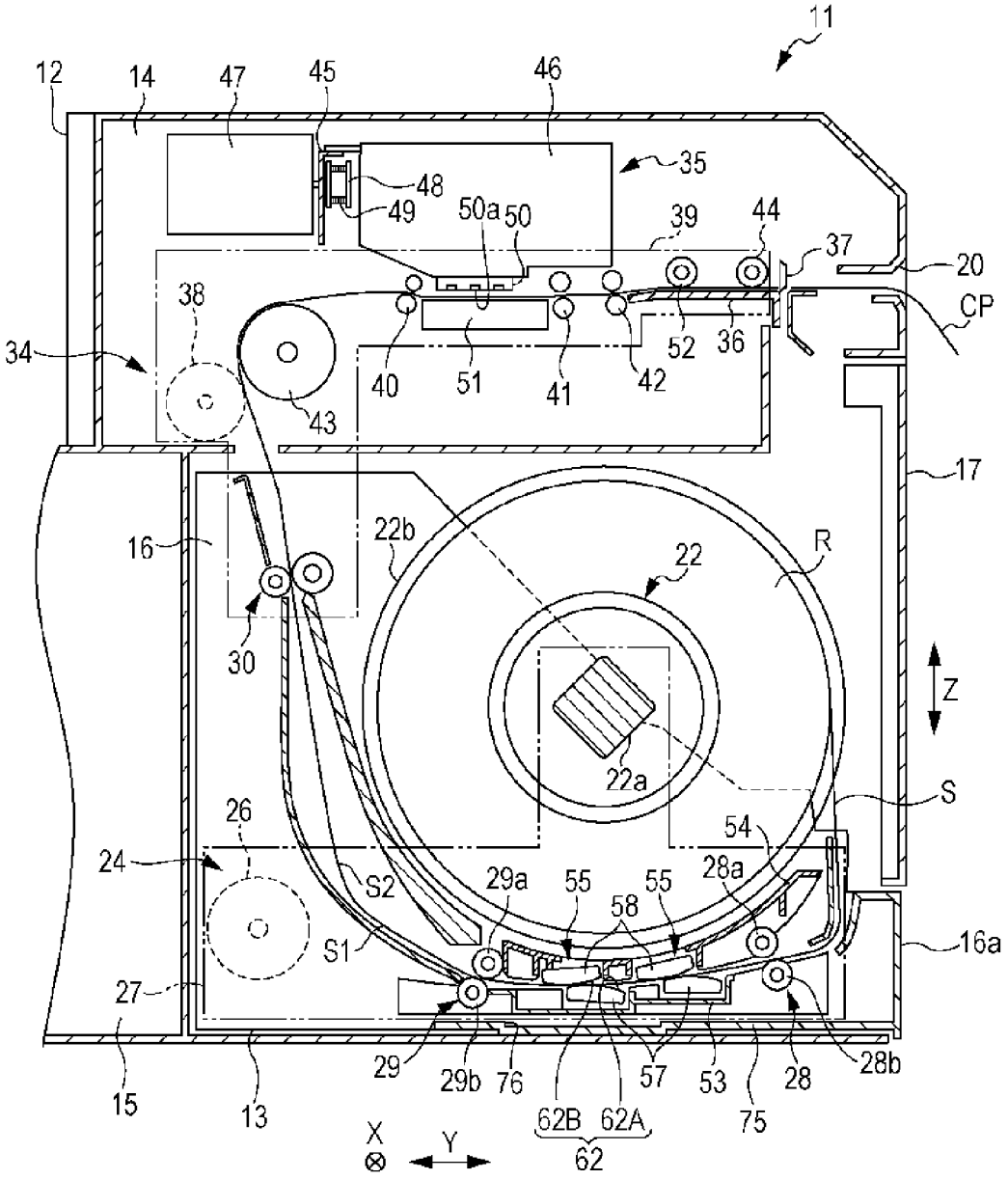
FIG. 3 is a cross-sectional view illustrating the overall configuration of a liquid ejecting apparatus.

As shown in FIG. 3, a feed mechanism 24 for feeding the paper S toward the second housing section 14 is held by the holding frame 16. A feed mechanism 24 includes a feed motor 26 serving as a driving source, a power transmission mechanism 27 for transmitting driving power from the feed motor 26, and transport roller pairs 28 and 29 that pinch and transport the paper S. In addition, a transport roller pair 30 is disposed in the vicinity of a downstream end of the holding frame 16 in the transport path (feed path) of the paper. Note that the transport roller pair 28 is an example of a first transport roller pair, the transport roller pair 29 is an example of a second transport roller pair, and the transport roller pair 30 is an example of a third transport roller pair.

The transport roller pair 28 is configured of a driving roller 28*a* that rotates under the driving power from the feed motor 26 and a slave roller 28*b* that forms a pair with the driving roller 28*a*. The transport roller pair 29 is configured of a driving roller 29*a* that rotates under the driving power from the feed motor 26 and a slave roller 29*b* that forms a pair with the driving roller 29*a*.

In the case where the paper S is fed toward the second housing section 14, the driving rollers 28*a* and 29*a* rotate in a first rotational direction, corresponding to the clockwise direction in FIG. 3, as a result of the feed motor 26 rotationally driving those rollers in a first direction. When the driving rollers 28*a* and 29*a* rotate in the first rotational direction, the paper S is let out from the roll member R and fed toward the second housing section 14. Note that the feed motor 26 performs driving intermittently when feeding the paper S, and thus the paper S is held in a sagging state between the transport roller pair 29 and the transport roller pair 30.

On the other hand, when the feed motor 26 performs rotational driving in a second direction that is the opposite direction to the first direction, the driving rollers 28*a* and 29*a* rotate in a second rotational direction, corresponding to the counter-clockwise direction in FIG. 3, and the paper S is returned in the opposite direction to the feed direction. Note that when the feed motor 26 performs rotational driving in the second direction, the flanges 22*b* that hold the roll member R are rotated in the counter-clockwise direction in FIG. 3 under the driving power of the feed motor 26, and the paper S that has been returned is taken up onto the roll member R as a result.

A transport mechanism 34 for transporting the paper S toward the discharge port 20, a recording unit 35 that records by ejecting ink onto the paper S transported by the transport mechanism 34, a heater 36 for drying the paper S to which the ink adheres, and a cutter 37 for cutting the paper S are housed in the second housing section 14.

The transport mechanism 34 includes a transport motor 38 serving as a driving source, a power transmission mechanism 39 for transmitting driving power from the transport motor 38, the transport roller pair 30 as well as transport roller pairs 40, 41, and 42 that pinch and transport the paper S, an intermediate roller 43 that rotates under the driving power from the transport motor 38, and a discharge roller 44.

The recording unit 35 includes a guide rail 45 that extends along the width direction X, a carriage 46 held on the guide rail 45 so as to be capable of moving back and forth in the width direction X, and a carriage motor 47 serving as a driving source for moving the carriage 46 along the guide rail 45.

Furthermore, the recording unit 35 includes a pair of pulleys 48 (only one of which is shown in FIG. 3) disposed at a predetermined distance from each other in the width direction X and an endless timing belt 49 stretched upon the pair of pulleys 48. One of the pulleys 48 is linked to an output shaft of the carriage motor 47. The carriage 46, which is fixed to one part of the timing belt 49, moves back and forth along the guide rail 45 when the carriage motor 47 drives forward and in reverse.

A liquid ejecting unit 50 capable of ejecting ink onto the paper S is held in a lower portion of the carriage 46. A plurality of liquid ejecting nozzles 50*a* are formed in a bottom surface of the liquid ejecting unit 50. Furthermore, a support member 51 for supporting the paper S is disposed below the carriage 46 along the transport path, between the transport roller pair 40 and the transport roller pair 41.

A set range of the support member 51 in the depth direction Y serves as a printing region. The paper S is intermittently transported by the transport mechanism 34 on a distance basis corresponding to the printing region. The paper S is printed on by ejecting ink onto the paper S, which is stopped on the support member 51, from the liquid ejecting nozzles 50*a* of the liquid ejecting unit 50 held in the carriage 46 that moves back and forth.

The paper S that has been recorded (printed) onto by the recording unit 35 is dried by being transported along a top surface of the plate-shaped heater 36. Note that a pressure roller 52 for pressing the paper S and the discharge roller 44 are provided above the heater 36.

The paper S that has passed above the heater 36 and has been dried is cut by the cutter 37 to a length corresponding to the portion that has been recorded onto, producing a single sheet CP. The recorded single sheet CP is then discharged to the exterior of the case body unit 12 through the discharge port 20.

A guide member 53 for guiding the fed paper S along a first surface S1 thereof and a guide portion 54 for guiding the paper S along a second surface S2 on the opposite side thereof to the first surface are provided in the holding frame 16, in a position between the transport roller pair 28 and the transport roller pair 29 in the feed path of the paper S. Note that in this embodiment, the first surface S1 of the paper S is a front surface onto which the ink is ejected, whereas the second surface S2 of the paper S is a rear surface onto which ink is not ejected.

Meanwhile, a plurality (in this embodiment, two) of removal mechanisms 55 for removing adhering objects that adhere to the paper S, such as paper particles, are provided in the holding frame 16, in positions in the feed path of the paper S that are between the transport roller pair 28 and the transport roller pair 29. Note that the paper S is fed with tension applied thereto so that the paper S does not sag down between the transport roller pair 28 and the transport roller pair 29.

Figure 4:
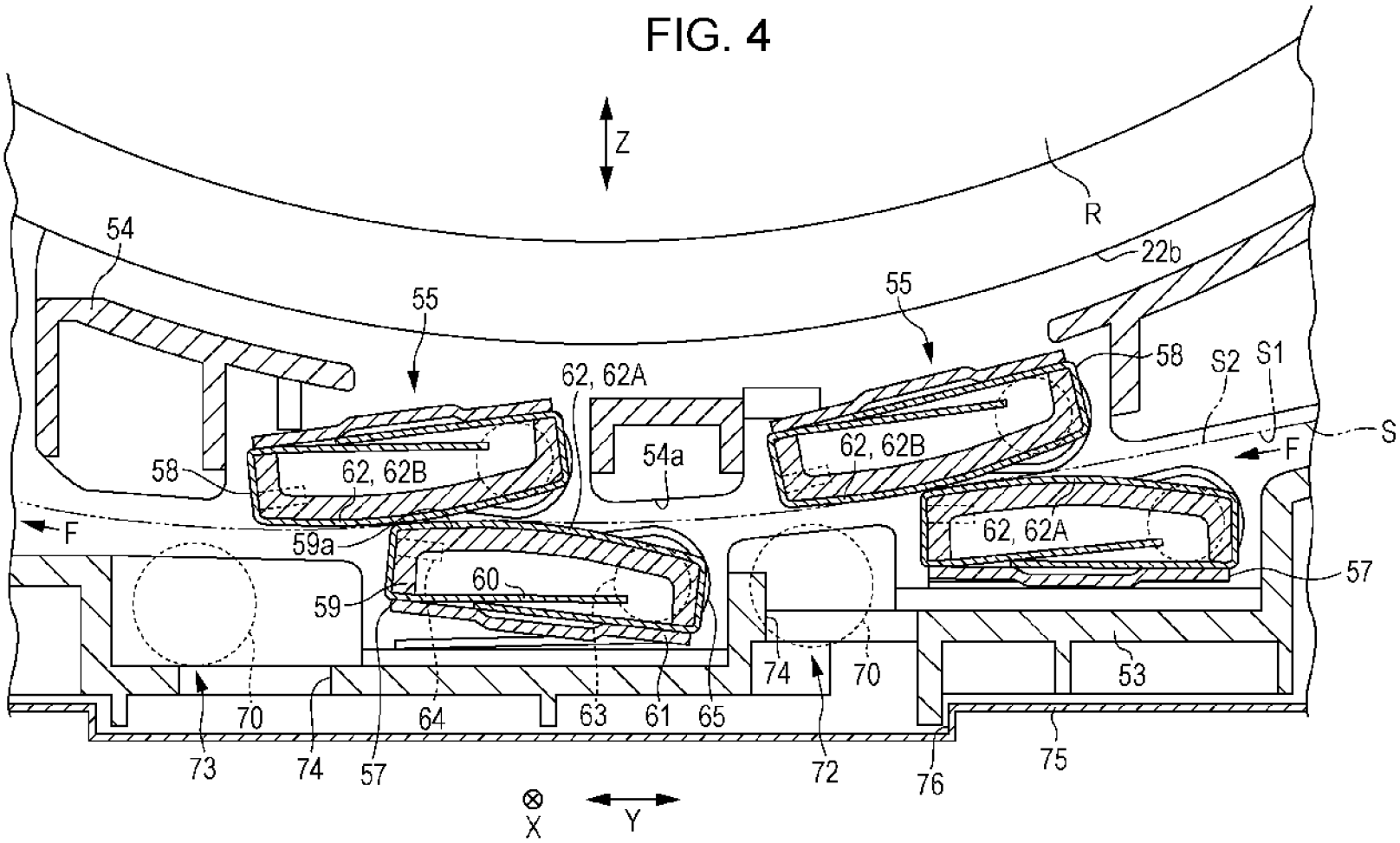
FIG. 4 is a cross-sectional view illustrating the configuration of a removal mechanism.

As shown in FIG. 4, each removal mechanism 55 includes a first removal member 57 that is disposed below the feed path, and a second removal member 58 that is disposed above the feed path and that forms a pair with the first removal member 57. In other words, a plurality of pairs formed by the first removal member 57 and the second removal member 58 are provided in the holding frame 16, along the feed path (the transport path) of the paper S.

The first removal member 57 is held by the guide member 53, whereas the second removal member 58 is held by the guide portion 54. The first removal member 57 and the second removal member 58 are disposed so as to partially overlap with each other in a feed direction (transport direction) F of the paper S, and so that end portions thereof on upstream and downstream sides in the feed direction F are distanced from each other in the feed direction F. Furthermore, in each removal mechanism 55, the first removal member 57 is disposed further upstream in the feed direction than the second removal member 58.

As a result, the second removal member 58 is disposed so that the end thereof on the downstream side in the feed direction F is disposed further downstream in the feed direction F than the first removal member 57. Note that the second removal member 58 in the removal mechanism 55 positioned on the upstream side in the feed direction is disposed so as to be distanced, in the feed direction F, from the first removal member 57 in the removal mechanism 55 positioned on the downstream side in the feed direction. Furthermore, a guide protrusion 54*a* for guiding the second surface S2 side of the paper S is provided in the guide portion 54 in a position between the two second removal members 58 in the feed direction F.

The first removal member 57 and the second removal member 58 are disposed in different locations but have the same configuration. The first removal member 57 and the second removal member 58 each include a frame member 59 having a curved surface portion 59*a* that curves along the feed direction F, a sheet member 60 that encloses the frame member 59, and an anchoring member 61 for anchoring the sheet member 60 to the frame member 59. Note the sheet member 60 can employ a nonwoven fabric such as felt, synthetic leather, or the like. In each removal mechanism 55, the portions of the sheet members 60 that are wrapped so as to cover the curved surface portions 59*a* of the frame members 59 configure removal portions 62 (62A and 62B).

In this embodiment, the removal portion 62 in the first removal member 57 functions as a first removal portion 62A, whereas the removal portion 62 in the second removal member 58 functions as a second removal portion 62B. The first removal portion 62A and the second removal portion 62B have the same shape, and the second removal portion 62B is disposed above the first removal portion 62A. The first removal portion 62A and the second removal portion 62B remove adhering objects that adhere to the paper S by making contact with both surfaces of the paper S so as to pinch the paper S as the paper S is being fed with the first surface S1 thereof, which serves as the printing surface, facing downward.

A pivot shaft 63 is provided on both sides of the frame member 59 in the width direction X in a position that is upstream in the feed direction, whereas an engagement projection 64 is provided on the side of the frame member 59 in the width direction X in a position that is downstream in the feed direction. Note that first shaft receiving portions (not shown) that support the pivot shaft 63 of the first removal member 57 in a pivotable state are formed in the guide member 53 so as to be arranged in the feed direction F. On the other hand, second shaft receiving portions (not shown) that support the pivot shaft 63 of the second removal member 58 in a pivotable state are formed in the guide portion 54 so as to be arranged in the feed direction F.

Figure 5:
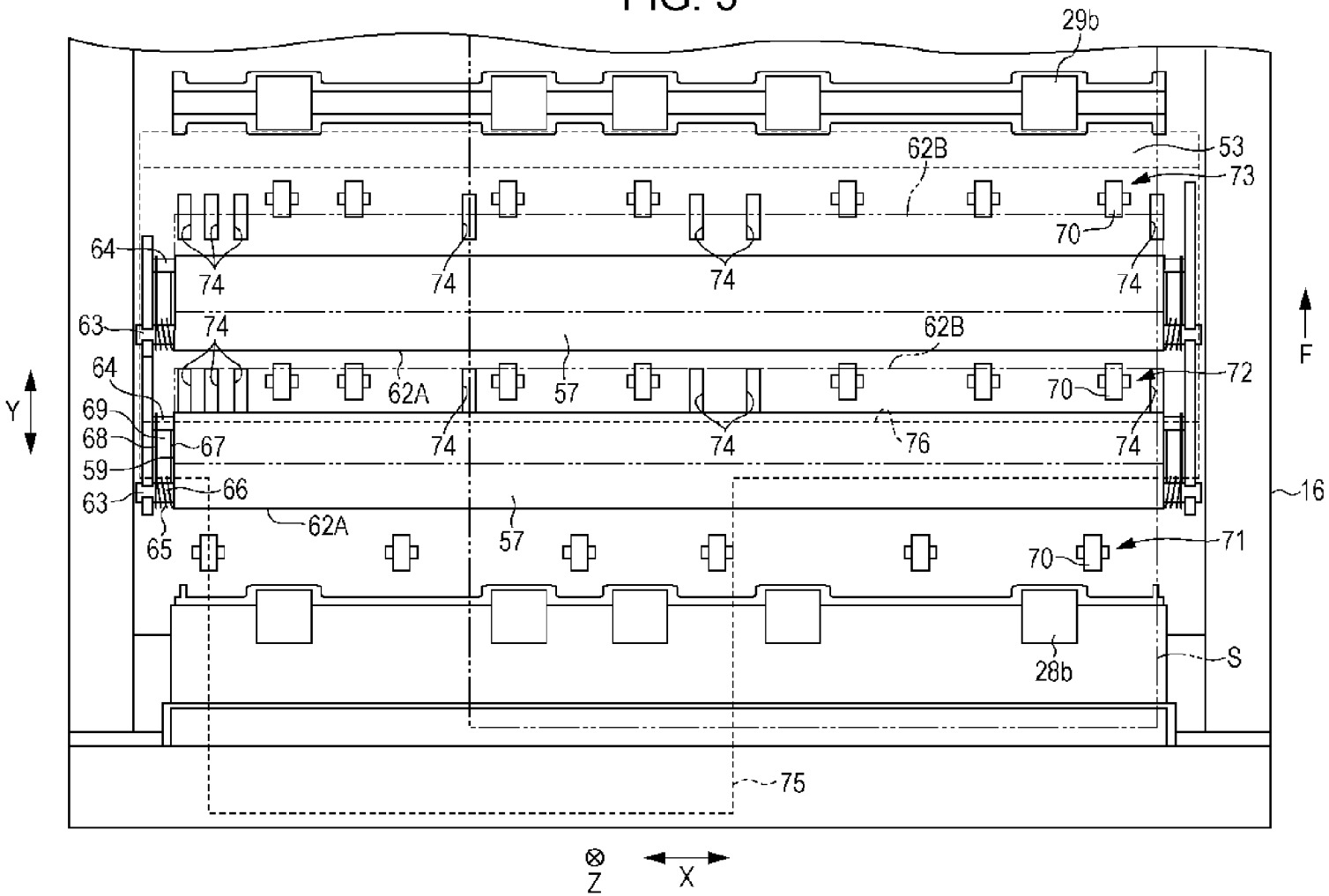
FIG. 5 is a top view illustrating the configuration of a transport path for a medium.

As shown in FIG. 5, a coil portion 66 of a torsion coil spring 65 is wound around the pivot shaft 63 of the frame member 59. Note that the torsion coil spring 65 is an example of a biasing member that biases the end portion of the frame member 59 on the downstream side in the feed direction toward the paper S side.

Arm portions 67 and 68 extend from the coil portion 66 of the torsion coil spring 65. One arm portion 67 of the torsion coil spring 65 is engaged with the engagement projection 64 of the frame member 59. In addition, an engagement base portion 69 with which the other arm portion 68 of the torsion coil spring 65 wound around the pivot shaft 63 of the first removal member 57 engages is provided in the guide member 53.

Guide portions 71, 72, and 73 configured of a plurality of rollers 70 arranged in the width direction X are disposed in the guide member 53 so as to be arranged from the upstream side to the downstream side in the feed direction F. Furthermore, a plurality of through-holes 74 are formed in positions near the guide portions 72 and 73 in the feed direction F, so as to be arranged in the width direction X.

The through-holes 74 provided in the guide member 53 are disposed in positions, in the width direction X, that correspond to the ends of various possible widths of the paper S. In addition, the through-holes 74 are disposed, in the feed direction F, below an area of the second removal portion 62B, indicated by the double-dot-dash line in FIG. 5, that corresponds to the downstream side in the feed direction. A base plate portion 75 is provided in a base area of the holding frame 16. A receptacle portion 76 that collects the adhering objects such as paper particles that have fallen from the second removal portion 62B after those adhering objects have been removed from the paper S and gathered on the second removal portion 62B is formed as a recess in the base plate portion 75, in a position that is below the through-holes 74.

Figure 6:
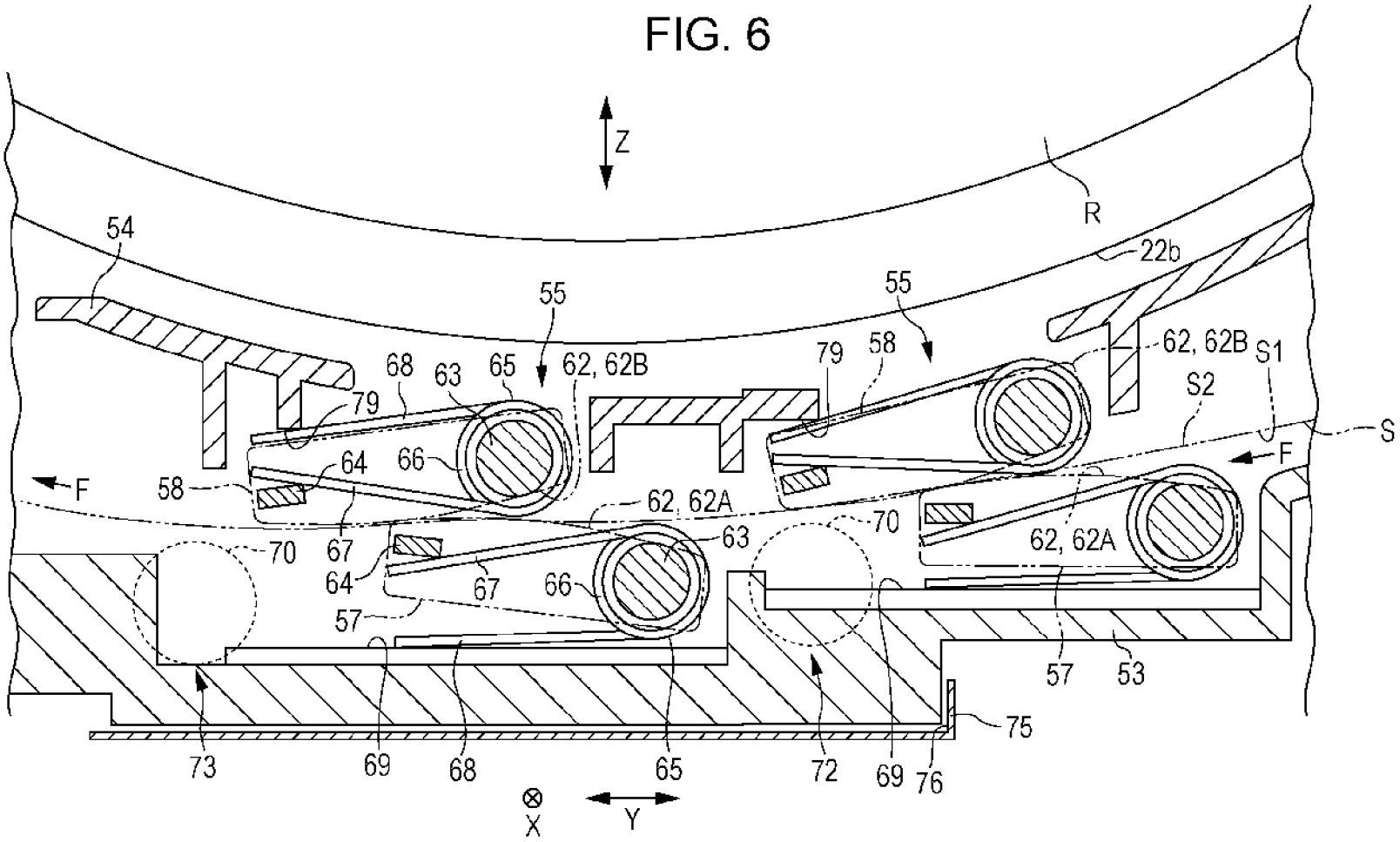
FIG. 6 is a cross-sectional view illustrating the configuration of a removal mechanism.

As shown in FIG. 6, an engagement portion 79, with which the other arm portion 68 that extends from the coil portion 66 of the torsion coil spring 65 wound upon the pivot shaft 63 of the second removal member 58 engages, is provided in the guide portion 54.

The first removal member 57 and the second removal member 58 are provided so as to be capable of pivoting central to the pivot shaft 63. While the end of the first removal member 57 on the downstream side in the feed direction is biased upward by the torsion coil spring 65, the end of the second removal member 58 on the downstream side in the feed direction is biased downward by the torsion coil spring 65.

As a result, the curved surfaces of the first removal portion 62A and the second removal portion 62B that form a pair oppose each other, and when the paper S is not interposed therebetween, the end of the first removal portion 62A on the downstream side in the feed direction makes contact with the vicinity of the center of the second removal portion 62B in the feed direction F.

When the area of contact between the first removal portion 62A and the second removal portion 62B is taken as a contact area, the paper S first makes contact with an area of the lower removal portion 62A that is further upstream in the feed direction than the contact area. The paper S then passes through the contact area while being guided by the first removal portion 62A, and then makes contact with an area of the second removal portion 62B that is further downstream in the feed direction than the contact area. In the case where the paper S is then fed, the first removal portion 62A and the second removal portion 62B press upon the paper S at the contact area, rather than making contact with each other.

To compare the two removal mechanisms 55 arranged in the feed direction F, the first removal member 57 positioned on the upstream side in the feed direction is disposed higher in the vertical direction Z than the first removal member 57 positioned on the downstream side in the feed direction. Likewise, the second removal member 58 positioned on the upstream side in the feed direction is disposed higher in the vertical direction Z than the second removal member 58 positioned on the downstream side in the feed direction.

Furthermore, an angle of intersection (contact angle) between the paired first removal portion 62A and the second removal portion 62B formed toward the upstream side in the feed direction from the contact area is greater in the removal mechanism 55 positioned on the downstream side in the feed direction F than in the removal mechanism 55 positioned on the upstream side in the feed direction F. In particular, the end of the first removal portion 62A positioned on the downstream side in the feed direction F that is on the upstream side in the feed direction is tilted so as to be lower than the first removal portion 62A that is positioned on the upstream side in the feed direction and higher in the vertical direction Z.

As a result, the separation distance in the vertical direction Z between the end of the second removal portion 62B on the upstream side in the feed direction and the first removal portion 62A is greater in the removal mechanism 55 positioned on the downstream side in the feed direction F than in the removal mechanism 55 positioned on the upstream side in the feed direction F.

Next, operations of the liquid ejecting apparatus 11 configured as above will be described.

As shown in FIG. 4, adhering objects such as paper particles that adhere to the paper S are removed by the first removal portion 62A of the first removal member 57 in the removal mechanism 55 making contact with the first surface S1 side of the paper S. Meanwhile, adhering objects such as paper particles that adhere to the paper S are removed by the second removal portion 62B of the second removal member 58 making contact with the second surface S2 side of the paper S. The first removal member 57 and the second removal member 58 are biased toward each other by the torsion coil spring 65, and thus the paper S is pinched at the area in the feed direction (the transport direction) F where those members overlap with each other, which removes the adhering objects with certainty.

Here, "paper particles" refers to fibrous pieces that make up the paper S, dust from materials contained in or applied to the paper S, and so on. For example, the paper S may contain or be coated with calcium carbonate as a whitening pigment, kaolin or the like for adding gloss, and so on. If, for example, calcium carbonate or the like enters into the liquid ejecting nozzles 50*a*, the ink within the liquid ejecting nozzles 50*a* will thicken significantly, leading to a risk of severe clogs that are difficult to eliminate.

With respect to this point, in this embodiment, the paper particles are removed not only from the first surface S1 of the paper S, which corresponds to the printing surface, but also from the second surface S2; this suppresses the paper particles from advancing into the periphery of the liquid ejecting unit 50 along with the paper S, which suppresses the liquid ejecting nozzles 50*a* from becoming clogged as a result.

Furthermore, because the plurality of paired first removal portions 62A and second removal portions 62B are provided along the feed path of the paper S, adhering objects that could not be removed by the removal mechanism 55 on the upstream side in the feed direction are removed by the removal mechanism 55 on the downstream side in the feed direction.

Furthermore, the paired first removal portion 62A and second removal portion 62B are biased toward each other, so that the curved surfaces thereof make contact with each other, by the torsion coil spring 65, upon which the coil portion 66 is wound on the upstream side of the first removal member 57 and the second removal member 58 in the feed direction F. Accordingly, the paper S passes through the contact area between the first removal portion 62A and the second removal portion 62B against the biasing force from the coil spring 65, resulting in increased friction between the paper S and the removal portion 62 and removing more adhering objects.

Because the removal portion 62 is configured of the comparatively soft sheet member 60 in order to ensure friction, the angle at which the paper S that has passed through the removal mechanism 55 on the upstream side enters into the removal mechanism 55 positioned on the downstream side may vary. With respect to this point, in this embodiment, the angle of intersection formed toward the upstream side in the feed direction from the contact area between the first removal portion 62A and the second removal portion 62B is greater in the removal mechanism 55 positioned on the downstream side in the feed direction F than in the removal mechanism 55 positioned on the upstream side in the feed direction F.

In particular, the end of the first removal portion 62A positioned on the downstream side in the feed direction F that is on the upstream side in the feed direction is tilted so as to be lower than the first removal portion 62A that is positioned on the upstream side in the feed direction and higher in the vertical direction Z. Accordingly, even in the case where the position of the leading end of the paper S that has passed through the removal mechanism 55 positioned on the upstream side in the feed direction varies, the leading end of the paper S can be brought into contact with the first removal portion 62A.

Furthermore, the first-pair first removal portion 62A, the first-pair second removal portion 62B, the rollers 70 of the guide portion 72, the guide protrusion 54*a* of the guide portion 54, the second-pair first removal portion 62A, the second-pair second removal portion 62B, and the rollers 70 of the guide portion 73 are disposed in the feed path of the paper S, along the feed direction F, alternately on the top and the bottom of the feed path. In addition, the first removal portion 62A and the second removal portion 62B guide the paper S in the feed direction F along the curved surfaces that are curved along the feed direction F. Accordingly, the transport of the paper S is not inhibited even in the case where the first removal portion 62A and the second removal portion 62B make contact with the leading end of the paper S and remove adhering objects therefrom.

In addition, unlike configurations that remove adhering objects from the paper S using cylindrical rollers, brush rollers, or the like, the removal portions 62 extend along the feed direction F, and thus a greater surface area makes contact with the paper S in the feed direction F; this makes it possible to remove more of the adhering objects. Furthermore, in the case where the cylindrical rollers, brush rollers, or the like rotate with the movement of the paper S, less friction is produced with the paper S, resulting in diminished effectiveness in wiping off adhering objects. As opposed to this, the removal portion 62 has fixed surfaces that press against the paper S, resulting in greater friction, which makes it possible to remove more adhering objects.

As shown in FIG. 3, the medium holding portion 22 is disposed below the liquid ejecting unit 50, and the feed path of the paper S extends upward, toward the liquid ejecting unit 50, from below the medium holding portion 22. In addition, the removal portion 62 is disposed in a position in the vertical direction that is below the support shaft 22*a* (the rotational center of the roll member R) and an outer circumferential surface (a lower end) of the maximum radius of the roll member R held on the medium holding portion 22, and is the lowermost area in the transport path of the paper S.

In other words, the removal portion 62 removes adhering objects that have adhered to the paper S in the feed path of the paper S that is located below the medium holding portion 22. Accordingly, the adhering objects such as paper particles that have been removed from the paper S by the removal portion 62 are held in the lowermost area of the transport path of the paper S, in a location that is below the liquid ejecting unit 50 and the medium holding portion 22. Through this, the adhering objects removed by the removal portion 62 are suppressed from adhering to the paper S, the liquid ejecting unit 50, and so on that are located above the removal portion 62.

In addition, the three transport roller pairs 28, 29, and 30, which are arranged along the feed direction from the medium holding portion 22 side toward the liquid ejecting unit 50 side, are provided in the first housing section 13 in order to feed the paper S. In addition, tension is applied to the paper S as the paper S is fed between the first transport roller pair 28 positioned on the upstream side in the feed direction F and the second transport roller pair 29 positioned on the downstream side in the feed direction. On the other hand, the paper S is held in a sagging state between the third transport roller pair 30 located downstream from the second transport roller pair 29 in the feed direction F and the second transport roller pair 29.

The removal portion 62 is disposed between the transport roller pair 28 and the transport roller pair 29 that transport the paper S with tension being applied thereto. Accordingly, the removal portion 62 can efficiently remove adhering objects such as paper particles by sliding along the paper S to which tension is applied.

Furthermore, the transport path extends upward between the transport roller pair 29 and the transport roller pair 30. Accordingly, disposing the removal portion 62 downstream from the transport roller pair 30 in the feed direction leads to a risk that the adhering objects removed by the removal portion 62 will adhere, for example, to the paper S held in a sagging state between the transport roller pair 29 and the transport roller pair 30. With respect to this point, in this embodiment, the removal portion 62 is disposed in a location that is lower than the transport path between the transport roller pair 29 and the transport roller pair 30 where the paper S is held in a sagging state and that is upstream from the transport roller pair 29 in the feed direction, and thus the stated risk can be reduced.

As shown in FIG. 4, the second removal portion 62B is disposed so as to face downward, and the end thereof on the downstream in the feed direction is disposed further downstream in the feed direction than the first removal portion 62A located therebelow. Accordingly, adhering objects that have adhered to the second removal portion 62B may fall downward, such as when the following end of the paper S passes. However, even in such a case, the through-holes 74 are formed below an area of the second removal portion 62B on the downstream side in the feed direction, and thus the adhering objects will not accumulate on the guide member 53 that forms the feed path of the paper S. Furthermore, the receptacle portion 76 of the base plate portion 75 is disposed below the through-holes 74, and thus paper particles and the like cleared outside from the transport path through the through-holes 74 are held in the receptacle portion 76.

The paper S first makes contact with the removal portion 62 of the removal mechanism 55 disposed on the upstream side in the feed direction F, and thus a greater amount of paper particles and the like will adhere to the removal portion 62 of the removal mechanism 55 disposed on the upstream side in the feed direction than to the removal portion 62 of the removal mechanism 55 disposed on the downstream side in the feed direction.

With respect to this point, in this embodiment, of the two second removal members 58 arranged in the feed direction F, the second removal member 58 positioned on the upstream side in the feed direction is disposed higher in the vertical direction Z than the second removal member 58 positioned on the downstream side in the feed direction. Accordingly, the second removal portion 62B positioned on the upstream side in the feed direction is separated from the receptacle portion 76 in the vertical direction Z by a greater distance than the second removal member 58 positioned on the downstream side in the feed direction. As a result, a greater amount of adhering objects can be deposited in the receptacle portion 76 positioned below the second removal portion 62B on the upstream side in the feed direction.

Here, in the case where the end, on the upstream side in the feed direction, of the first removal portion 62A positioned below the transport path is in contact with the vicinity of the center, in the feed direction F, of the second removal portion 62B positioned above the transport path, adhering objects that have adhered to the first removal portion 62A cannot fall downward. In addition, in the case where the first removal portion 62A and the second removal portion 62B make contact with each other in the vicinity of the respective centers on the downstream side in the feed direction, the ends of those portions on the downstream side in the feed direction make contact with each other, and so on, the amount of surface area that makes contact with the paper S in the feed direction F will be reduced. Furthermore, in the case where the ends of the first removal portion 62A and the second removal portion 62B on the upstream side in the feed direction make contact with each other, the paper S cannot be guided by the curved surfaces of the removal portion 62, and thus the paper S will have difficulty in passing the contact area.

As opposed to this, in this embodiment, the end of the first removal portion 62A on the downstream side in the feed direction makes contact with the vicinity of the center of the second removal portion 62B in the feed direction F, and thus the paper S can be guided toward the contact area by the first removal portion 62A. In addition, the removal performance of the second removal portion 62B is suppressed from dropping as a result of the adhering objects that have adhered to the second removal portion 62B falling into the receptacle portion 76. Furthermore, a greater amount of surface area contact can be ensured between the first removal portion 62A and the second removal portion 62B in the feed direction F, and thus more adhering objects are removed.

In addition, as shown in FIG. 3, the holding frame 16 holds the medium holding portion 22, the removal portion 62, the guide member 53, and the base plate portion 75, and can be pulled out from the first housing section 13 of the case body unit 12; the receptacle portion 76 is provided in the base plate portion 75 of the holding frame 16. Accordingly, the paper particles and the like held in the receptacle portion 76 will not easily scatter inside the case body unit 12, outside the first housing section 13, and so on, even in the case where the holding frame 16 is pulled out from the first housing section 13 of the case body unit 12.

According to the embodiment described thus far, the following effects can be achieved.

1. The first removal portion 62A and the second removal portion 62B partially overlap in the transport direction, and thus adhering objects that have adhered to the paper S can be removed efficiently. In addition, the first removal portion 62A and the second removal portion 62B are disposed so that the ends thereof on the upstream side in the transport direction are distanced from each other in the feed direction F, and thus adhering objects that have adhered to the leading end and the like of the paper S can be removed without inhibiting the transport of the paper S. In other words, the first removal portion 62A and the second removal portion 62B can, using a simple configuration, remove adhering objects that have adhered to the ends and so on of the paper S, without inhibiting the transport of the paper S onto which ink is ejected.

2. The second removal portion 62B disposed above the first removal portion 62A is disposed so that the end thereof on the downstream side in the transport direction is further downstream in the transport direction than the first removal portion 62A, and thus adhering objects that have accumulated on the second removal portion 62B can be suppressed from falling downward and adhering to the first removal portion 62A.

3. The first removal portion 62A and the second removal portion 62B have the same shape, and thus the configuration can be simplified. In addition, by disposing the first removal portion 62A further upstream in the transport direction than the second removal portion 62B, the ends of the first removal portion 62A and the second removal portion 62B can be distanced from each other in the transport direction.

4. The first-pair second removal portion 62B is distanced in the transport direction from the second-pair first removal portion 62A, which is disposed downstream therefrom in the transport direction, and thus adhering objects that have accumulated on the first-pair second removal portion 62B can be suppressed from falling downward and adhering to the second-pair first removal portion 62A.

5. The first removal portion 62A and the second removal portion 62B are curved in the transport direction, and thus the paper S can be guided along the transport direction. In addition, the first removal portion 62A and the second removal portion 62B extend in the transport direction, and thus the ranges thereof that make contact with the paper S can be increased, which in turn makes it possible to remove more adhering objects.

6. The first removal portion 62A and the second removal portion 62B are each configured of the sheet member 60 that is attached so as to cover the curved surface portion 59*a* of the frame member 59, and thus the paper S can be guided along the transport direction. In addition, replacing the sheet member 60 makes it possible to restore the removal capabilities of the first removal portion 62A and the second removal portion 62B. Furthermore, the end of the frame member 59 on the downstream side in the transport direction is biased toward the paper S by the torsion coil spring 65, and thus the pressure with which the first removal portion 62A and the second removal portion 62B make contact with the paper S can be increased, enabling the adhering objects to be removed with more certainty.

7. The paper S makes contact with the first removal portion 62A and the second removal portion 62B while being transported with the first surface S1 facing downward, and thus adhering objects removed from the paper S can be suppressed from adhering to the first surface S1 onto which the ink is ejected.

8. In the case where adhering objects that have accumulated on the second removal portion 62B have fallen downward, the adhering objects can be cleared outside from the transport path through the through-holes 74. In addition, by collecting the adhering objects in the receptacle portion 76 provided below the through-holes 74, the adhering objects can be held outside the transport path. Accordingly, the adhering objects can be expelled outside the transport path of the paper S, and thus the adhering objects can be suppressed from adhering to the paper S and the like.

9. The removal portion 62 removes adhering objects that have adhered to the paper S, in the feed path of the paper S that is positioned below the medium holding portion 22; thus the adhering objects removed by the removal portion 62 are held below the medium holding portion 22. Through this, the adhering objects that have fallen from the removal portion 62 can be suppressed from adhering to the paper S in the feed path, the medium holding portion 22, and so on that are located above the removal portion 62. Accordingly, the adhering objects removed by the removal portion 62 can be suppressed from adhering to the paper S that is fed to the liquid ejecting unit 50.

10. The medium holding portion 22 is disposed below the liquid ejecting unit 50, and the feed path extends toward the liquid ejecting unit 50 from below the medium holding portion 22; thus the adhering objects removed by the removal portion 62 are held in a location that is below the liquid ejecting unit 50 and the medium holding portion 22. Accordingly, the adhering objects that have fallen from the removal portion 62 can be suppressed from adhering to the paper S, the liquid ejecting unit 50, and so on.

11. The removal portion 62 is disposed below the support shaft 22*a* that supports the roll member R in a rotatable state, and thus the adhering objects removed by the removal portion 62 are held below the roll member R. Accordingly, adhering objects that have fallen from the removal portion 62 can be suppressed from adhering to the roll member R.

12. The removal portion 62 is disposed between the transport roller pair 28 and the transport roller pair 29 that transport the paper S while applying tension thereto, and thus the adhering objects can be efficiently removed by the removal portion 62 sliding along the paper S to which the tension is applied.

13. In the case where adhering objects that have accumulated on the removal portion 62 have fallen downward, the adhering objects can be cleared outside from the transport path through the through-holes 74. In addition, by collecting the adhering objects in the receptacle portion 76 provided below the through-holes 74, the adhering objects can be held outside the transport path. Accordingly, the adhering objects can be expelled outside the transport path of the paper S, and thus the adhering objects can be suppressed from adhering to the paper S and the like.

14. The second housing section 14 that houses the liquid ejecting unit 50 is disposed above the first housing section 13, which is capable of housing the holding frame 16 that holds the removal portion 62; thus adhering objects that have been removed by the removal portion 62 can be suppressed from entering into the second housing section 14 and adhering to the liquid ejecting unit 50. In addition, the receptacle portion 76 is provided in a base area of the holding frame 16, and thus adhering objects that have been cleared outside from the transport path can be suppressed from scattering within the case body unit 12.

Note that the aforementioned embodiment may be modified as described hereinafter.

The shape, configuration, and so on of the removal portion can be changed as desired. For example, the removal portion may be configured of rollers, brushes, or the like that can make contact with the paper S. Furthermore, such a removal portion may be configured to make contact with only one of the surfaces of the paper S.

The configuration may be such that only one removal mechanism 55 is provided, or may be such that three or more removal mechanisms 55 are provided.

In the case where a plurality of removal mechanisms 55 are provided, the type of the sheet member 60, the biasing force of the torsion coil spring 65, the length of the removal portion 62, and so on may be varied from removal mechanism 55 to removal mechanism 55, the shapes of the first removal member 57 and the second removal member 58 therein may be varied, and so on. Note that in such a case, the variation may be such that removal mechanisms 55 on the upstream side in the feed direction remove large types of debris such as fibrous pieces and removal mechanisms 55 on the downstream side in the feed direction remove fine particle types such as materials contained in or applied to the paper S.

The removal portion 62 may be disposed between the support shaft 22*a* (the rotational center of the roll member R) and the location of the lower end of the outer circumferential surface of the maximum radius of the roll member R held on the medium holding portion 22, in the vertical direction Z. Note that in this case, it is preferable for the removal portion 62 to be disposed lower than a center position between the rotational center of the roll member R and the lower end of the roll member R in the vertical direction Z.

A removal member having a roll shape, a brush shape, or the like may be provided in a position of contact with the removal portion 62 in order to remove adhering objects that have adhered to the removal portion 62.

The two second removal members 58 arranged in the feed direction F may be disposed at the same height in the vertical direction Z, or the second removal member 58 positioned on the upstream side in the feed direction may be disposed lower in the vertical direction Z than the second removal member 58 positioned on the downstream side in the feed direction.

The angle of intersection (contact angle) between the first removal portion 62A and the second removal portion 62B may be the same in both the removal mechanisms 55.

The configuration may be such that the first removal member 57 and the second removal member 58 are removable and adhering objects are cleared from within the transport path by replacing the first removal member 57 and the second removal member 58.

The first removal portion 62A and the second removal portion 62B may have different lengths in the feed direction F. In this case, part of the removal portion 62 that is longer in the feed direction F may overlap with the entire removal portion 62 that is shorter in the feed direction F.

The transport path of the paper S may be configured to extend toward a position that is lower than the medium holding portion 22 after first extending upward from below the medium holding portion 22.

The removal portion 62 may be brought into contact with the paper S that is transported along the vertical direction Z.

The paper is not limited to a long roll shape. In other words, the single sheet CP may be set in a medium holding unit.

The liquid ejecting apparatus 11 may be a printer that performs double-sided printing by ejecting ink onto both sides of the paper.

The medium is not limited to paper, and may be a plastic film, a board member, or the like. Alternatively, the medium may be a fabric used in textile printing devices or the like.

The through-holes 74 provided in the guide member 53 may be long-holes that extend in the width direction X.

The configuration may be such that the through-holes 74 are not provided in the guide member 53.

The biasing member is not limited to the torsion coil spring 65, and the frame member 59 may be biased by a plate spring, a rubber member, or the like.

The configuration may be such that the holding frame 16 cannot be pulled out from the case body unit 12.

The configuration may be such that the medium holding portion 22 and the liquid ejecting unit 50 are housed in the same housing section in the case body unit 12.

The receptacle portion 76 is not limited to a recessed area formed in the base plate portion 75, and a separate receptacle member that forms the receptacle portion 76 may be provided instead.

In the aforementioned embodiment, a liquid ejecting apparatus that ejects and discharges a liquid aside from ink may be employed as the liquid ejecting apparatus. Note that the state of the liquid ejected from the liquid ejecting apparatus as extremely fine droplets is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity, sol, gel water, other inorganic solvents, organic solvents, liquid solutions, liquid resins, and fluid states such as liquid metals (metallic melts). Furthermore, in addition to liquids as a single state of a matter, liquids in which the particles of a functional material composed of a solid matter such as pigments, metal particles, or the like are dissolved, dispersed, or mixed in a solvent are included as well. Ink as described in the above embodiment, liquid crystals, and the like can be given as representative examples of the liquid. Here, "ink" includes general water-based and oil-based inks, as well as various types of liquid compositions, including gel inks, hot-melt inks, and so on. Liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface emitting displays, and color filters can be given as specific examples of liquid ejecting apparatuses. Alternatively, the liquid ejecting apparatus may be a liquid ejecting apparatus that ejects bioorganic matters used in the manufacture of biochips, a liquid ejecting apparatus that is used as a precision pipette and that ejects liquids to be used as samples, textile printing equipment, a microdispenser, and so on. Furthermore, the invention may be employed in liquid ejecting apparatuses that perform pinpoint ejection of lubrication oils into the precision mechanisms of clocks, cameras, and the like, as well as in liquid ejecting apparatuses that eject transparent resin liquids such as ultraviolet curing resins onto a substrate in order to form miniature hemispheric lenses (optical lenses) for use in optical communication elements. The invention may also be employed in a liquid ejecting apparatus that ejects an etching liquid such as an acid or alkali onto a substrate or the like for etching.

The technical spirit that can be understood from the above embodiment and variations will be described below.

A. The liquid ejecting apparatus in which the medium holding unit includes a support portion that supports a roll member, upon which the medium having a long shape is wrapped in a cylindrical shape, in a rotatable state; and the removal unit is disposed below a rotational center of the roll member.

B. The liquid ejecting apparatus according to "A", further including: three or more transport roller pairs, arranged along a feed direction from a side on which the medium holding unit is located toward a side on which the liquid ejecting unit is located, for feeding the medium, in which the medium is fed while tension being applied to the medium between a first transport roller pair positioned on an upstream side in the feed direction and a second transport roller pair positioned on a downstream side in the feed direction, and the medium is held in a sagging state between a third transport roller pair, positioned downstream from the second transport roller pair in the feed direction and above the first transport roller pair and the second transport roller pair in a vertical direction, and the second transport roller pair; and the removal unit is disposed between the first transport roller pair and the second transport roller pair.

C. The liquid ejecting apparatus according to "B", in which the roll member is disposed so that the rotational center thereof is positioned above the first transport roller pair and the second transport roller pair and below the third transport roller pair in the vertical direction.

According to the configuration of "A" above, the removal unit is disposed lower than the rotational center of the roll member, and thus the adhering objects removed by the removal unit are suppressed from falling onto the roll member. Accordingly, adhering objects that have fallen from the removal unit can be suppressed from adhering to the roll member.

According to the configuration of "B" above, the removal unit is disposed between the first transport roller pair and the second transport roller pair that transport the medium while applying tension thereto, and thus the adhering objects can be efficiently removed by the removal unit sliding along the medium to which the tension is applied. In addition, the removal unit is disposed between the first transport roller pair and the second transport roller pair that are disposed lower than the third transport roller pair, and thus the adhering objects that have fallen from the removal unit can be suppressed from adhering to the medium in the transport path.

According to the configuration of "C" above, the removal unit is disposed between the first transport roller pair and the second transport roller pair that are disposed lower than the third transport roller pair and the rotational center of the roll member, and thus the adhering objects that have fallen from the removal unit can be suppressed from adhering to the medium in the transport path.

The entire disclosure of Japanese Patent Application No. 2012-221032, filed Oct. 3, 2012 is expressly incorporated by reference herein.

What is claimed is:

1. A liquid ejecting apparatus comprising:

a liquid ejecting unit that ejects a liquid onto a medium;

a medium holding unit that holds the medium to be fed to the liquid ejecting unit; and a removal unit that removes adhering objects that have adhered to the medium, in a feed path of the medium that is positioned lower than the medium holding unit, wherein the removal unit includes at least one fixed surface that presses against the medium in a feed direction of the medium, and wherein the medium holding unit and the removal unit are mounted to a holding frame slidably movable in the feed direction of the medium past the liquid ejecting unit, the medium holding unit and the removal unit moving together.

2. The liquid ejecting apparatus according to claim 1, wherein the medium holding unit is disposed lower than the liquid ejecting unit; and the feed path extends toward the liquid ejecting unit from below the medium holding unit.

3. The liquid ejecting apparatus according to claim 1, wherein the medium holding unit includes a support portion that supports a roll member, upon which the medium having a long shape is wrapped in a cylindrical shape, in a rotatable state; and the removal unit is disposed below the support portion.

4. The liquid ejecting apparatus according to claim 1, further comprising:

three or more transport roller pairs, arranged along a feed direction from a side on which the medium holding unit is located toward a side on which the liquid ejecting unit is located, for feeding the medium, wherein the medium is fed while tension being applied to the medium between a first transport roller pair positioned on an upstream side in the feed direction and a second transport roller pair positioned on a downstream side in the feed direction, and the medium is held in a sagging state between a third transport roller pair positioned downstream from the second transport roller pair in the feed direction and the second transport roller pair; and the removal unit is disposed between the first transport roller pair and the second transport roller pair in the feed direction.

5. The liquid ejecting apparatus according to claim 1, wherein the removal unit removes the adhering objects that have adhered to the medium by making contact with the medium that is transported in a state in which a first surface of the medium, onto which the liquid is ejected, faces downward.

6. The liquid ejecting apparatus according to claim 5, further comprising:

a guide member for guiding the first surface side of the medium to be fed, wherein a through-hole is provided in a position of the guide member that is below the removal unit, and a receptacle unit for collecting the adhering objects removed from the medium is disposed below the through-hole.

7. The liquid ejecting apparatus according to claim 6, further comprising:

the holding frame holds the guide member and the receptacle unit; and a case body unit including a first housing section capable of housing the holding frame, and a second housing section that is disposed above the first housing section and that houses the liquid ejecting unit, wherein the receptacle unit is provided in a base area of the holding frame.

8. The liquid ejecting apparatus according to claim 1, wherein the removal unit includes a first removal unit positioned on a first side of the medium and a second removal unit positioned on a second side of the medium, the first removal unit extending further downstream in a feed direction of the medium than the second removal unit.

* * * * *